United States Patent [19]

Schelfhorst

[11] Patent Number: 4,756,033

[45] Date of Patent: Jul. 12, 1988

[54] RESERVOIR FOR PLACING IN A FIXED POSITION ON THE GROUND AND METHOD FOR MANUFACTURING SAME

[76] Inventor: Hendrik W. Schelfhorst, Eerbeek 2, 8033 BJ Zwolle, Netherlands

[21] Appl. No.: 829,965

[22] Filed: Feb. 18, 1986

[30] Foreign Application Priority Data

Feb. 21, 1985 [NL] Netherlands ..... 8500497
Nov. 1, 1985 [NL] Netherlands ..... 8503003

[51] Int. Cl.[4] ..... E04H 3/18

[52] U.S. Cl. ..... 4/506; 4/488; 4/498; 52/169.1; 52/169.7; 52/245; 52/247

[58] Field of Search ..... 4/500, 506, 499, DIG. 16, 4/207, 498, 488; 52/724, 725, 169.1, 169.7, 245, 247, 249

[56] References Cited

U.S. PATENT DOCUMENTS

| | | | |
|---|---|---|---|
| 865,488 | 9/1907 | Graham | 52/724 X |
| 1,065,237 | 6/1913 | Graham | 52/169.1 X |
| 1,153,205 | 9/1915 | Edwards | 52/245 X |
| 1,963,980 | 6/1934 | Garrett | 52/169.1 X |
| 2,315,894 | 4/1943 | Crom | 52/249 X |
| 2,748,904 | 6/1956 | Arndt | 52/247 |
| 2,815,512 | 12/1957 | Meekin et al. | 52/245 |
| 3,008,148 | 11/1961 | Vierling | 4/500 |
| 3,468,088 | 9/1969 | Miller | 52/169.7 X |
| 3,608,099 | 9/1971 | Wall | 4/499 |
| 3,847,184 | 11/1974 | God | 4/DIG. 16 |

*Primary Examiner*—Henry K. Artis
*Attorney, Agent, or Firm*—John P. Snyder

[57] ABSTRACT

The invention is a reservoir for placing in a fixed position on the ground, for example a swimming pool or a storage tank for liquid and/or solid (bulk) goods having little or no cohesion, for example crop products, coal, manure, spreading salt and the like, having at least a bottom and an upright wall connecting thereto which is resistant to outwardly directed pressure. The invention further provides to this end a reservoir of the type referred to above which displays the feature that the upright wall consists of a number of vertical piles placed in a closed configuration at intervals from one another, a vertical wire mesh arranged between these piles and a bottom element extending on the bottom, on which element an upright wall part is formed or arranged resting against the inner side of the said wire mesh.

18 Claims, 11 Drawing Sheets

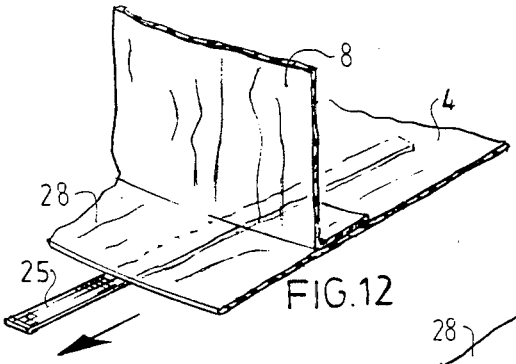
FIG.12
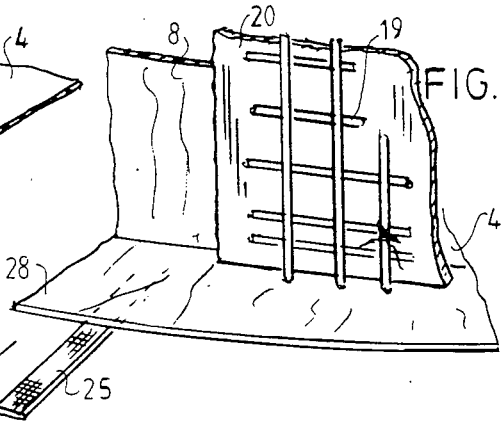
FIG.13
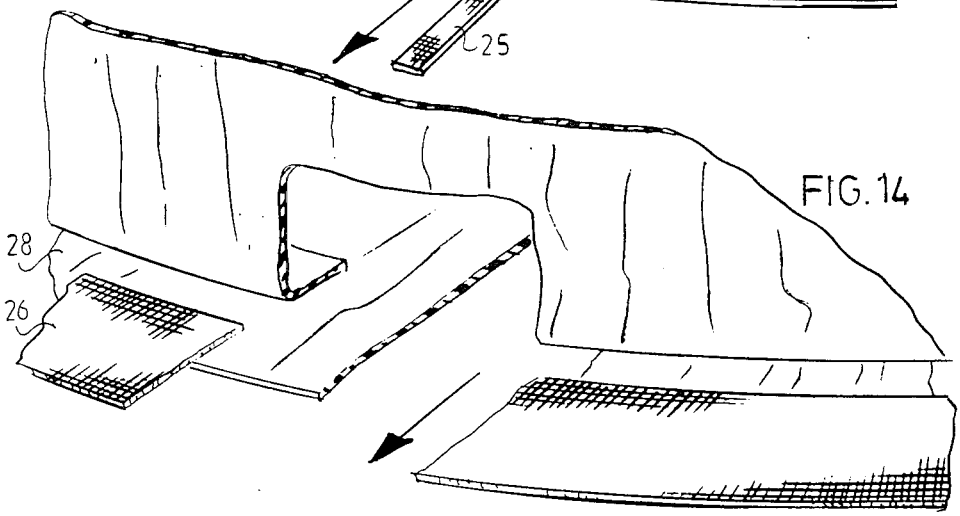
FIG.14
FIG.15
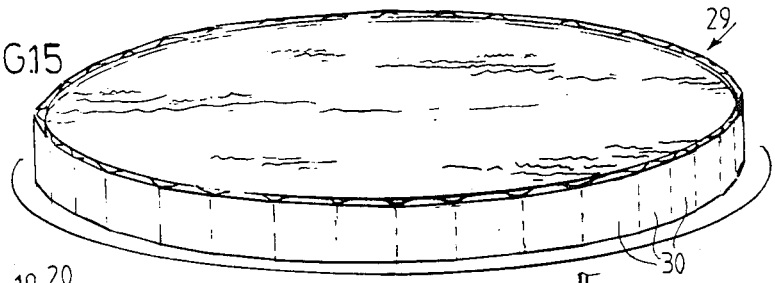
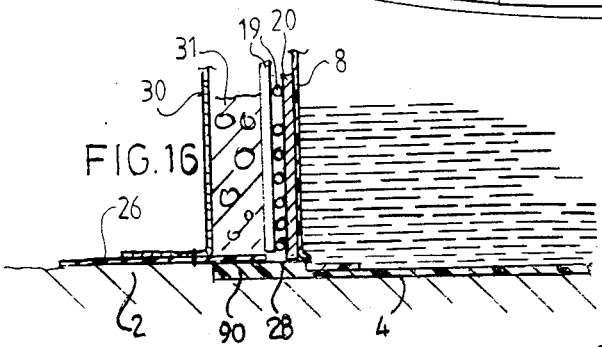
FIG.16
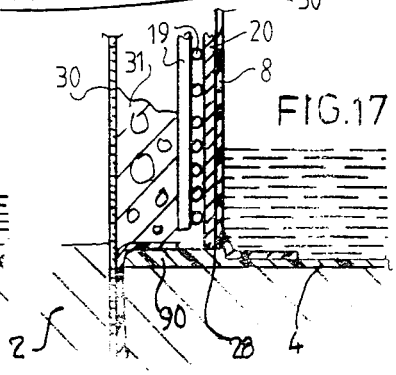
FIG.17

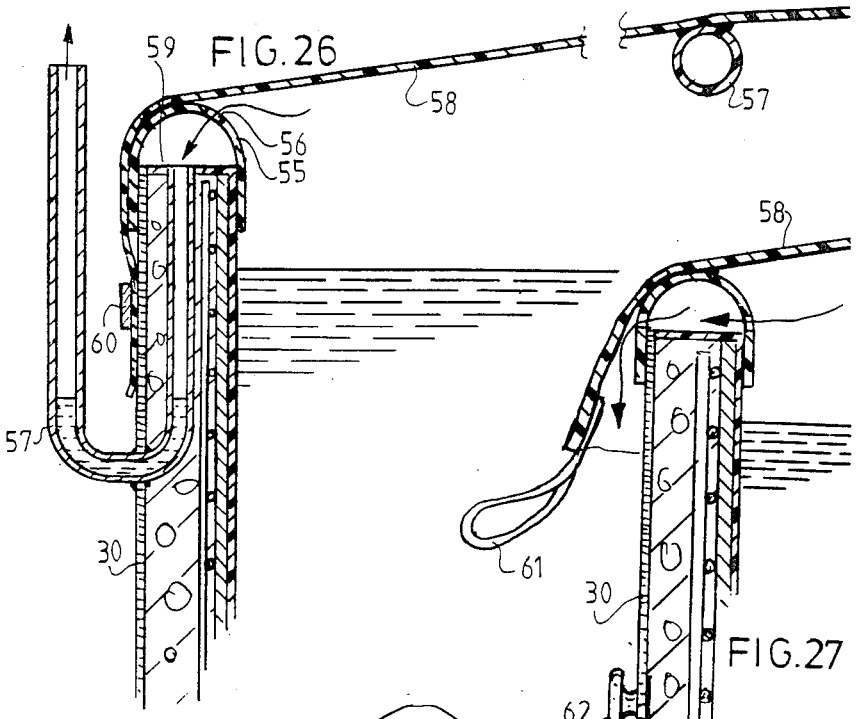
FIG. 26
FIG. 27
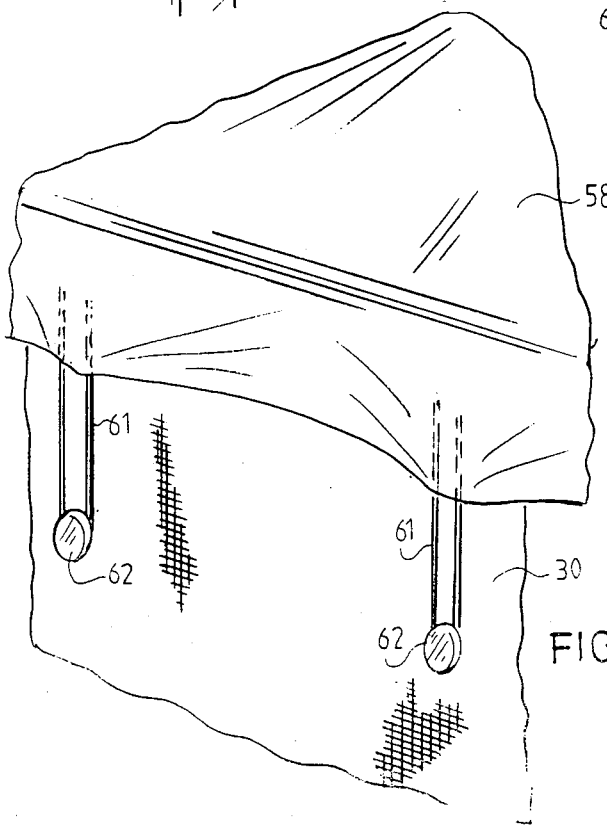
FIG. 28

RESERVOIR FOR PLACING IN A FIXED POSITION ON THE GROUND AND METHOD FOR MANUFACTURING SAME

The invention relates to a reservoir for placing in a fixed position on the ground, for example a swimming pool or a storage tank for liquid and/or solid (bulk) goods having little or no cohesion, for example crop products, coal, manure, spreading salt and the like, having at least a bottom and an upright wall connecting thereto which is resistant to outwardly directed pressure.

Such a reservoir is known in various forms. A current form is one in which the upright wall is formed by concrete or, if required, reinforced concrete. Such a reservoir has the drawback that it is comparatively expensive, as much because of the quantity of material required as the method of manufacturing that has to be followed, namely the placing of shutterings, the filling of these shutterings by pouring and their subsequent removal. This method does not moreover lead itself to application by little trained users.

The invention has for its object to now make a reservoir in a form such that it can be built very simply and with little knowledge and training at comparatively low cost.

The invention provides to this end a reservoir of the type referred to in the preamble which displays the feature that the upright wall consists of a number of vertical piles placed in a closed configuration at intervals from one another, a vertical wire mesh arranged between these piles and a bottom element extending on the bottom, on which element an upright wall part is formed or arranged resting against the inner side of the said wire mesh.

Each pile can consist advantageously of a vertical pile driven into the ground and anchored if necessary by cement or concrete. A very simple variant is one in which each pile inserted into this tube takes the form of a tube filled by pouring.

In order to achieve that the bottom is capable of good plastic deformation while preserving the required properties, for example impermeability to water, preference is given to the embodiment in which the bottom and upright wall connecting thereto comprise a layer of plastic material. By way of orientation: the bottom can consist of a several centimeter thick layer of (foaming) concrete arranged on the ground and a subsequent plastic membrane impermeable to water, onto which another layer of (foaming) concrete is arranged. This construction has the advantage of having a long deformation line and of adapting easily if necessary to small changes in the around structure.

In order to distribute the forces on the wire mesh as homogenously as possible, an embodiment can be applied which has the feature that between the vertical wire mesh attached to the vertical piles and the upright wall is arranged a substantially rigid board for distributing outwardly directed forces.

Yet another embodiment can display the feature that in addition to the upright wall part resting against the inner side of the piles, an upright wall part is arranged extending around the outer side of the piles and the space between both these wall parts is filled by pouring with a curing material such as (floating) concrete. Great wall strength is hereby achieved with very simple means, while contrary to the known art no use is made of shuttering to be removed later.

In another embodiment use can be made of a possibly slack roof covering which extends over the upper edge of the upright wall and is supported in the centre by for example a constructed horizontal beam. In this case the supporting beam can support on the bottom of the reservoir. The supporting beam can advantageously consist of a construction consisting of tubes filled by pouring, whereby the tubes form for example the ribs of a cube.

In a further practical embodiment the reservoir according to the invention can display the characteristic that the upright wall is provided close to its upper edge and above the maximum filling level of the reservoir with at least one gas outlet duct connecting to a tube with water seal. Such an embodiment is particularly of practical importance in the case of a reservoir serving as manure store.

Finally the invention extends to a method for manufacturing such a reservoir. This method can have the feature that, after levelling the ground where required, the reservoir bottom is laid thereon, that around this bottom vertical tubes are placed in the ground at intervals from one another, that upright piles are placed in these tubes, that these piles are anchored therein by a filling compound, that to the inner side of these piles is attached a circumferentially closed upright wire mesh and that a wall part formed or arranged on the bottom part is arranged against this wire mesh, covering same.

The invention will now be elucidated on the basis of the drawing, in which:

FIG. 12 is a bottom with tensioning members;

FIG. 13 shows a partly broken away perspective view of a detail corresponding to FIG. 12 with the wire mesh and a wall part;

FIG. 14 is a variant of the embodiment according to FIG. 12;

FIG. 15 shows a filled reservoir;

FIG. 16 shows a cross section through the wall construction;

FIG. 17 shows a view corresponding with FIG. 16 of a variant;

FIG. 26 shows a cross section through a wall with a roof and a water seal;

FIG. 27 shows the upper edge of a wall in cross section;

FIG. 28 shows a perspective view of a reservoir with a roof in the form of slack foil;

Figure 1:
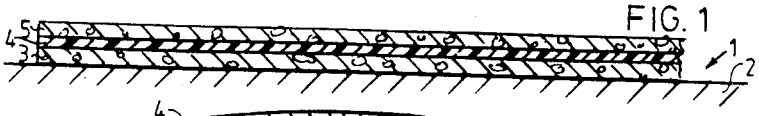
FIG. 1 is a cross section through a bottom.

FIG. 1 shows a bottom 1 consisting of a layer 3 of (foaming) concrete arranged on the ground 2, the concrete having arranged on it an impermeable membrane 4, on which is placed a layer of (foaming) concrete 5.

Figure 2:
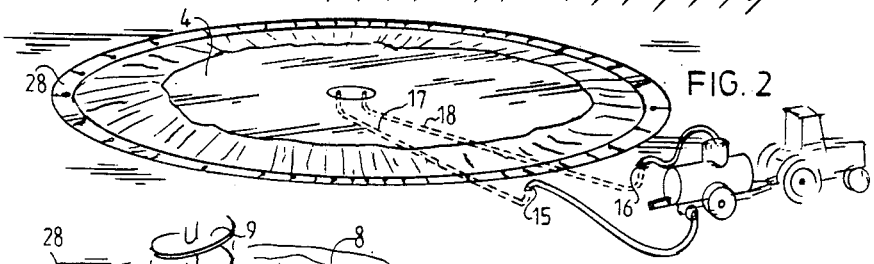
FIG. 2 shows a schematic view of a first phase in a method for manufacturing a reservoir.
Figure 3:
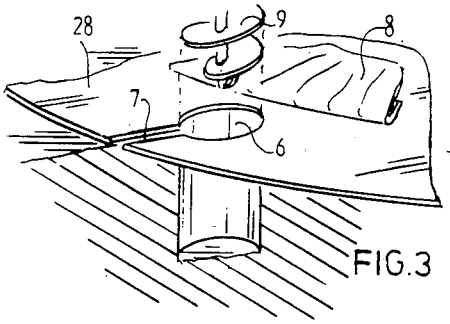
FIG. 3 shows the drilling of holes for vertical tubes.

FIG. 2 shows the laying of membrane or foil 4. This is round in shape and displays on its circumference holes 6 arranged at regular mutual intervals having radial slots 7 open to outside, as is shown in more detail in FIG. 3. These holes and slots are arranged in the edge zone 28. On the inner side of the edge zone is arranged a cylindrical casing shaped foil part 8 intended for the forming of an upright wall part.

Figure 4:
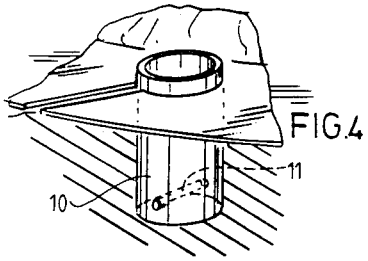
FIG. 4 shows a positioned vertical tube.
Figure 5:
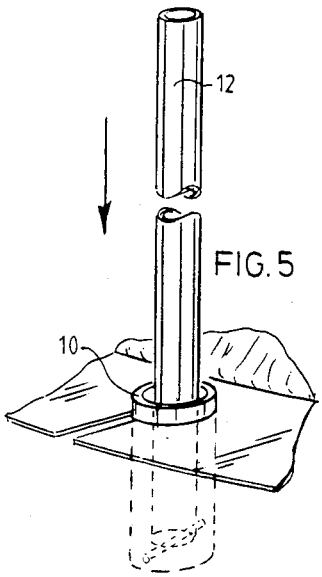
FIG. 5 shows the insertion of a vertical pile into a vertical tube.

After the laying of foil 4 holes are made in the ground via holes 6 using an earth drill 9. In accordance with FIG. 4, tubes 10 are placed therein, these tubes being provided on their underside with horizontal bearing pins 11 which serve in the way shown in FIG. 5 to support a pile 12 to be placed later.

Figure 6:
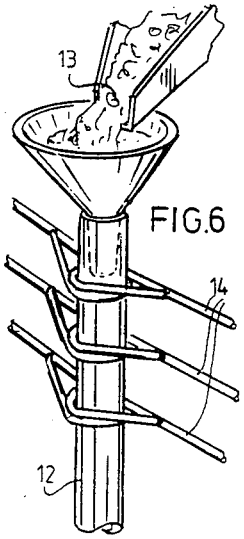
FIG. 6 shows the filling of a pile by pouring.

As FIG. 6 shows, such a pile can take the form of a tube later filled by pouring with concrete 13. FIG. 6 shows the manner of attaching wire mesh members 14 on pile 12. These horizontal wire mesh members 14 display on their ends loops consisting of an end that is bent round and welded.

Referring back to FIG. 2 it is noted that connections 15, 16 are positioned outside the yet to be placed reservoir such that the user can fill and empty the reservoir using his own means. For this purpose use is made of lines 17, 18 which emerge above foil 4. This aspect will be discussed further in reference to FIG. 32.

Figure 7:
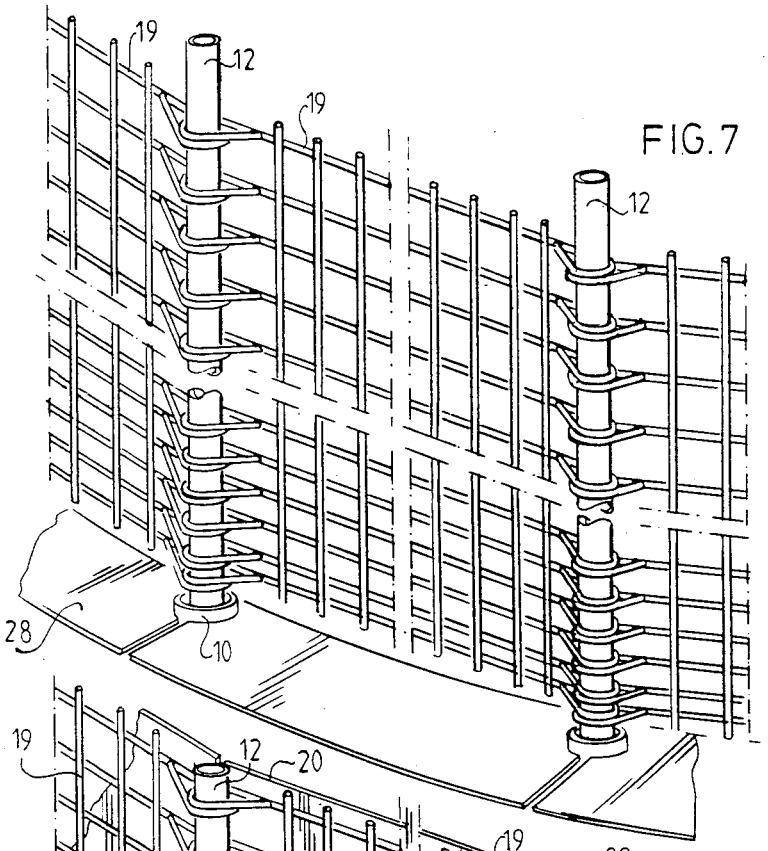
FIG. 7 is a construction consisting of a bottom and vertical piles with wire meshes arranged between them.

FIG. 7 shows how wire meshes 19 are linked with vertical piles 12.

Figure 8:
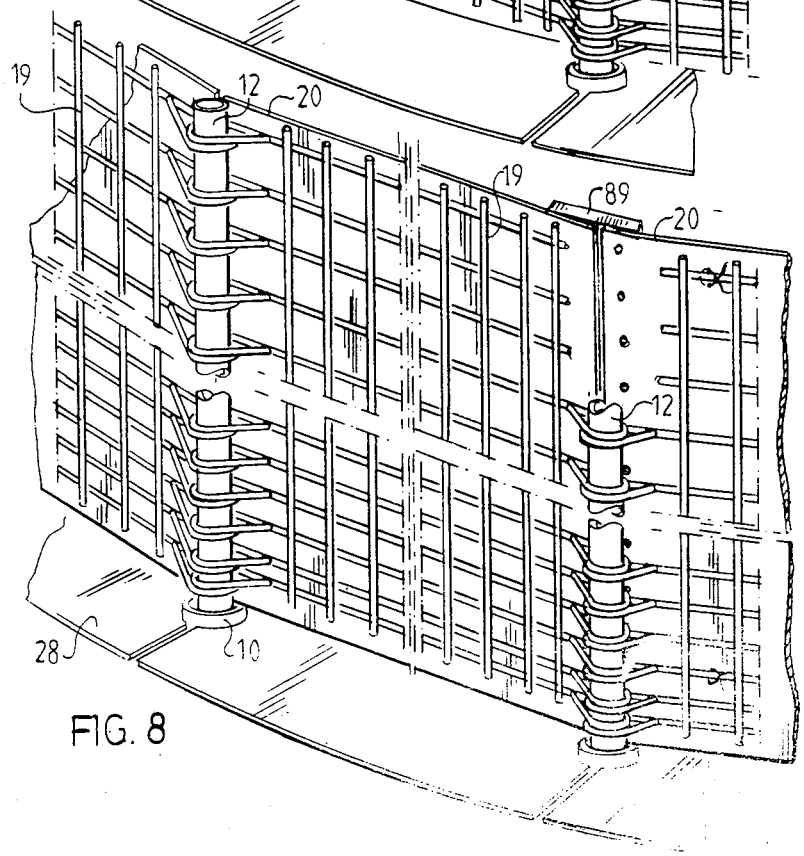
FIG. 8 shows wall elements arranged tyereby.

As FIG. 8 illustrates, boards 20 are arranged against wire mesh 19 on the inner side for the distribution of the force which the filling of a reservoir applies to the wire meshes. As according to FIG. 8 one board extends between two adjacent piles. A strip 89 is arranged on the inner side over the seam between boards 20. This is attached to only one board, in order to avoid possible thermal stress.

Figure 9:
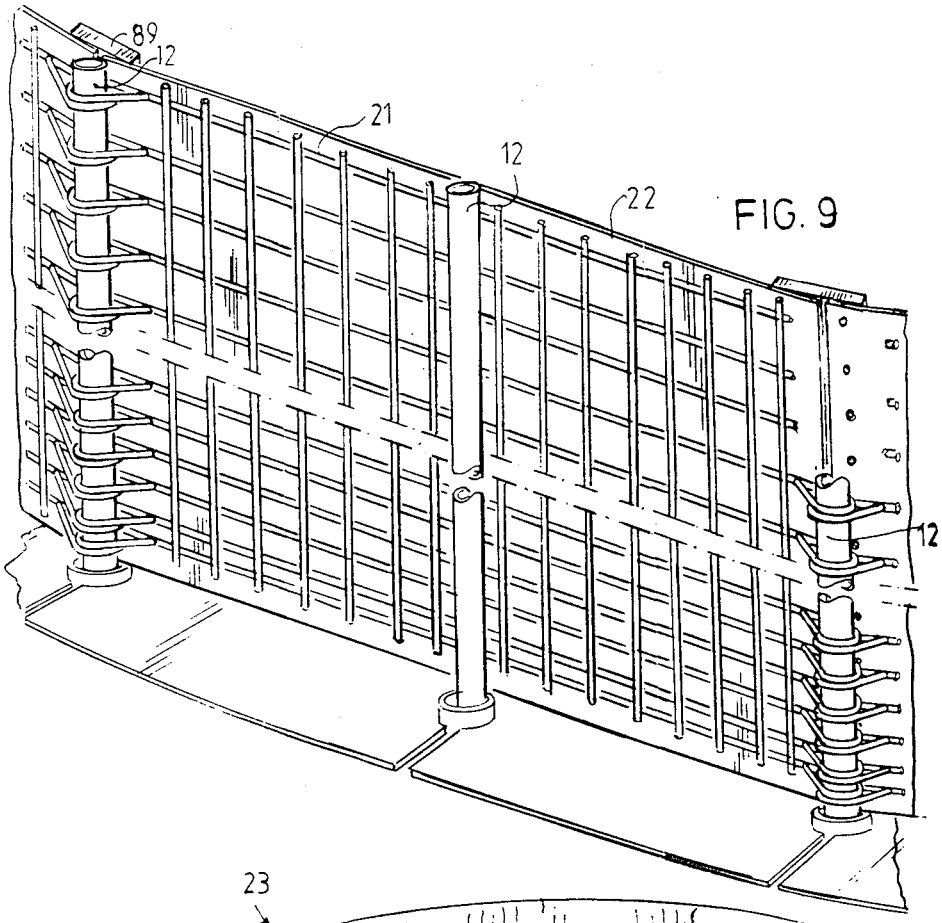
FIG. 9 is a variant of FIG. 8.

In the variant according to FIG. 9 wire meshes 21 are arranged between piles 12 leaving an intermediate pile free; the same applies to the associated boards 22.

There will usually be no fixed relationship between the length of the boards and the mutual spacing of the piles.

Figure 10:
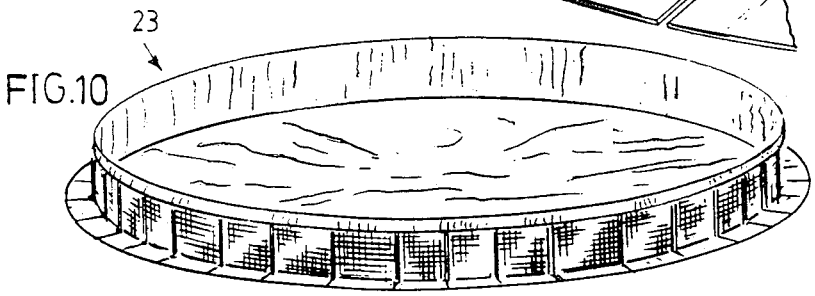
FIG. 10 shows a perspective view of a completed reservoir.

FIG. 10 shows a completed reservoir 23 in an embodiment, namely one in which the wire meshes are accessible on the outer side.

Figure 11:
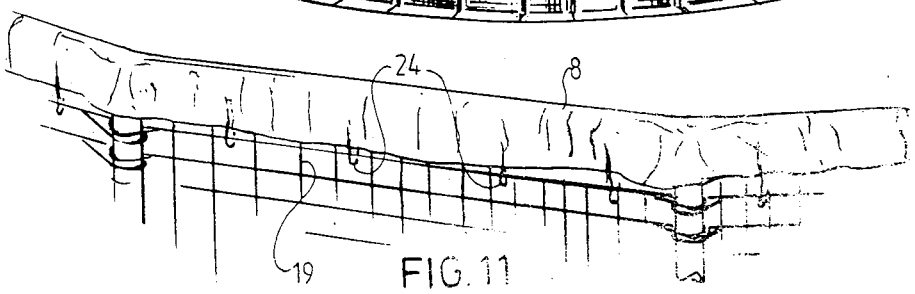
FIG. 11 shows an upper edge of the reservoir according to FIG. 10.

FIG. 11 shows a possible way of attaching upright foil part 8 to wire meshes 19, namely by means of hooks 24.

FIG. 12 shows edge zone 28 which in this embodiment is provided with tensioning lips 25 arranged with a regular distribution and extending in radial direction, which serve to tighten foil 4.

FIG. 13 shows this latter in the final configuration.

FIG. 14 shows a variant in which edge zone 28 is provided with an extra edge zone 26 having tensile strength which serves to replace tensioning lips 25. Edge zone 26 will be further mentioned in reference to FIG. 16 and 17.

FIG. 15 shows a completed reservoir 29. This differs from reservoir 23 according to FIG. 10 in that wire meshes 19 are no longer visible but are covered by wall parts 30 extending on the outer side. These wall parts can take the form of foil or reinforced synthetic textile strip or the like.

FIG. 16 and 17 show the construction of the said wall parts 30 as according to FIG. 15. As is seen in these figures, another wall part 30 is arranged outside each wire mesh 19 such that a pouring space results which is filled with a layer 31 of (foaming) concrete in the way indicated in these figures.

In the embodiment according to FIG. 16 edge zone 26 having tensioning strength is placed on the ground 2, while in the embodiment according to FIG. 17 edge zone 26 with the lower edge zone of wall part 30 coupled thereto is entrenched in the ground 2. The concrete wall is supported by a slide layer 90, over which edge zone 28 can slide in the case of load variations, for example varying fillings and temperature variations.

Prior to filling the pouring spaces with concrete 31 in the embodiment according to FIGS. 15, 16, 17 the reservoir is filled with the material it is intended for, such as water, spreading salt, sand or the like. In this way the wall construction comes under tensile stress. Filling by pouring under this stress results in a construction analogous to that of prestressed concrete. Without going into details it can be stated that the pouring height must be selected to conform with the specific weight of the pouring material and that of the filling of the reservoir. A partially prestressed construction is thus obtained in a very simple manner with all the resulting advantages, particularly in the unfilled state.

Figure 18:
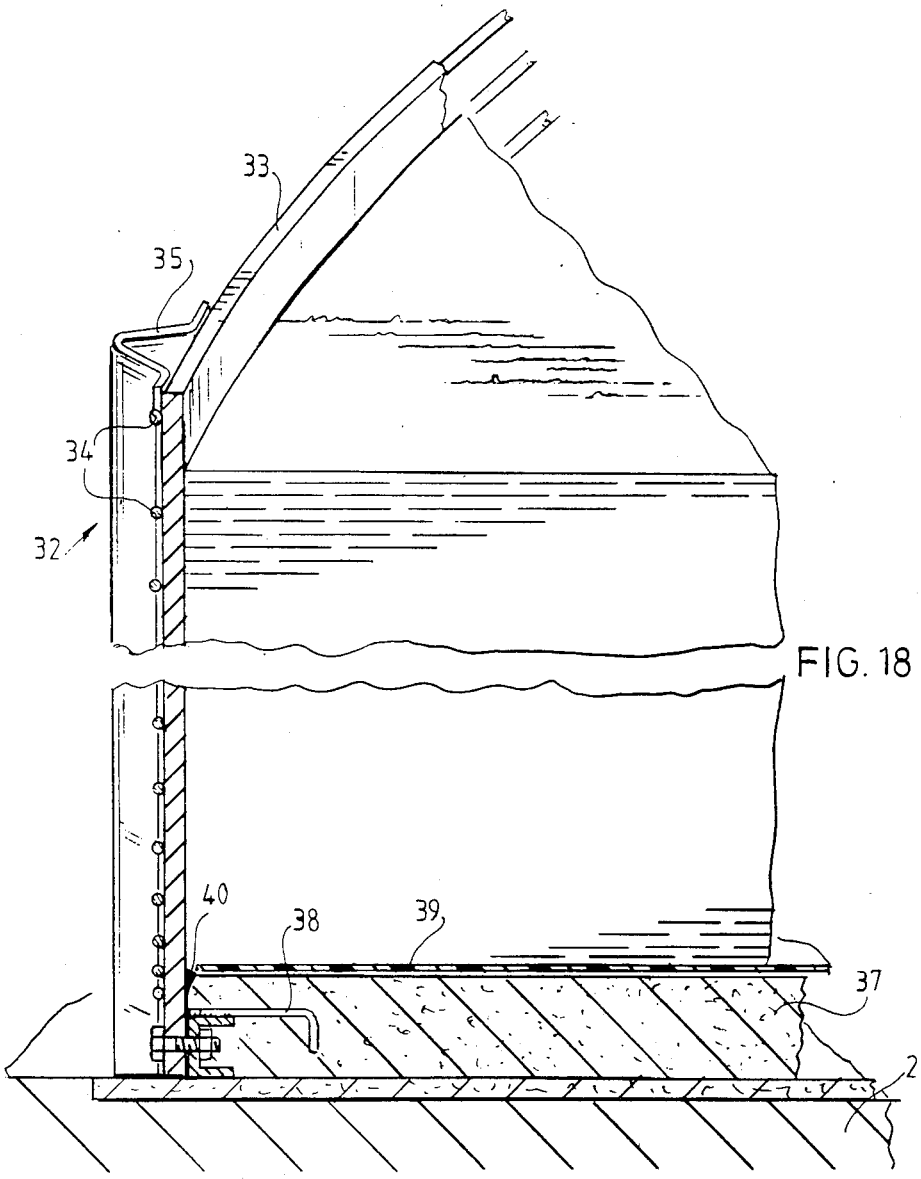
FIG. 18 is another embodiment, partly in perspective, partly in cross section.

FIG. 18 shows a reservoir 32 having an upright wall part 33 the outwardly directed force of which is absorbed by tensioned ropes 34. Attention is drawn to the fact that the mutual spacing of ropes 34 becomes greater with increasing height in view of the diminishing hydrostatic pressure, wholly analogous to the construction of wire meshes 19, 21 according to the FIGS. 7, 8, 9.

The vertical piles consist in this case of substantially omega shaped profiled beams 35 with recesses 36 (see FIG. 21) for the passage of ropes 34.

Wall parts 33 are anchored in bottom 37 by anchoring members 38.

On bottom 37 is placed a foil 39. The edge of this is sealing connected with wall part 33 by a weld zone 40. In the absence of foil, a mastic joint can be applied.

Figure 19:
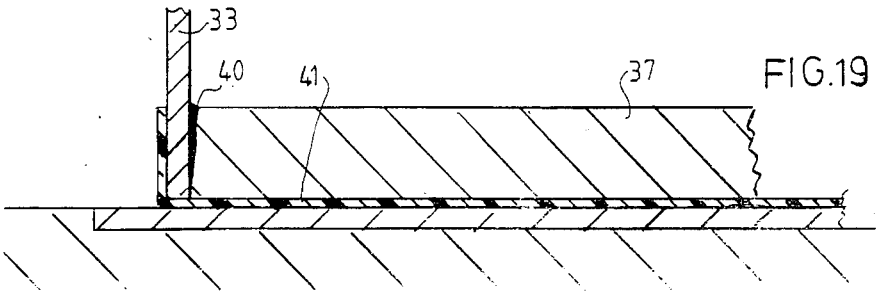
FIG. 19 shows a cross section through yet another embodiment.

FIG. 19 shows an alternative in which anchoring members 38 are omitted. A plastic foil 41 is situated under the bottom 37.

Figure 20:
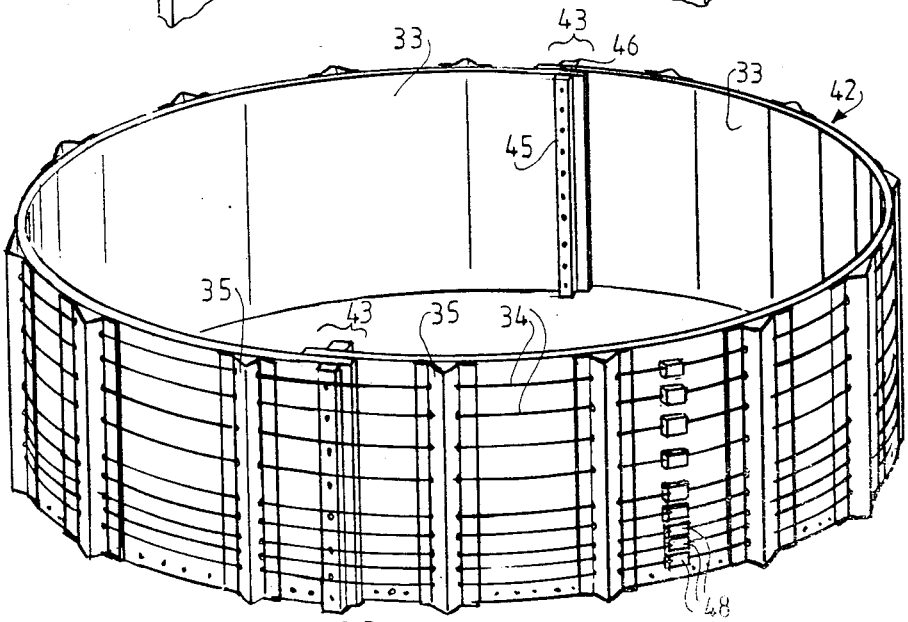
FIG. 20 shows a perspective view of the embodiment according to FIG. 18.

FIG. 20 shows a reservoir 42 having two wall parts 33 which are held together by ropes 34 which also co-operate with beams 35.

Figure 22:
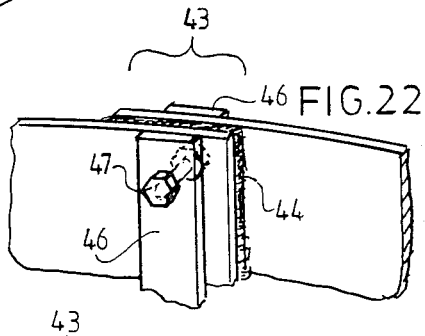
FIG. 22 shows the overlapping zone of two adjoining wall portions.

There are overlapping zones 43 present of the adjoining wall parts 33. These latter are sealing coupled there with one another. FIG. 22 shows how this coupling is carried out. Between both boards is located a rubber sealing strip 44, while two connecting strips 45 and 46 respectively are placed on the inner and outer side and coupled by bolts/nuts 47.

Figure 21:
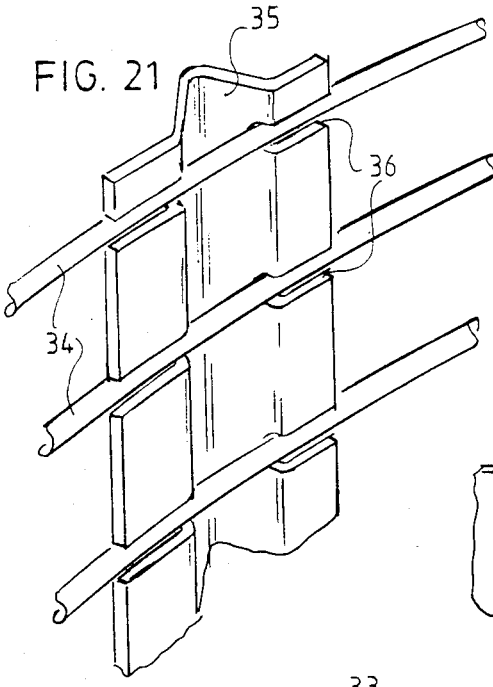
FIG. 21 is the construction of an upright tube.

FIG. 21 shows the construction of the omega shaped beams 35 and the manner of fixing of ropes 34.

Figure 23:
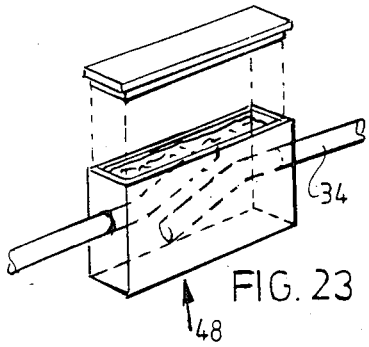
FIG. 23 shows the manner of attaching ends of ropes having tensile strength.

FIG. 23 shows the coupling element 48 as illustrated in FIG. 20. It consists of a housing into which the ends of rope 34 are inserted, after which the housing is filled with a curing plastic.

Figure 24:
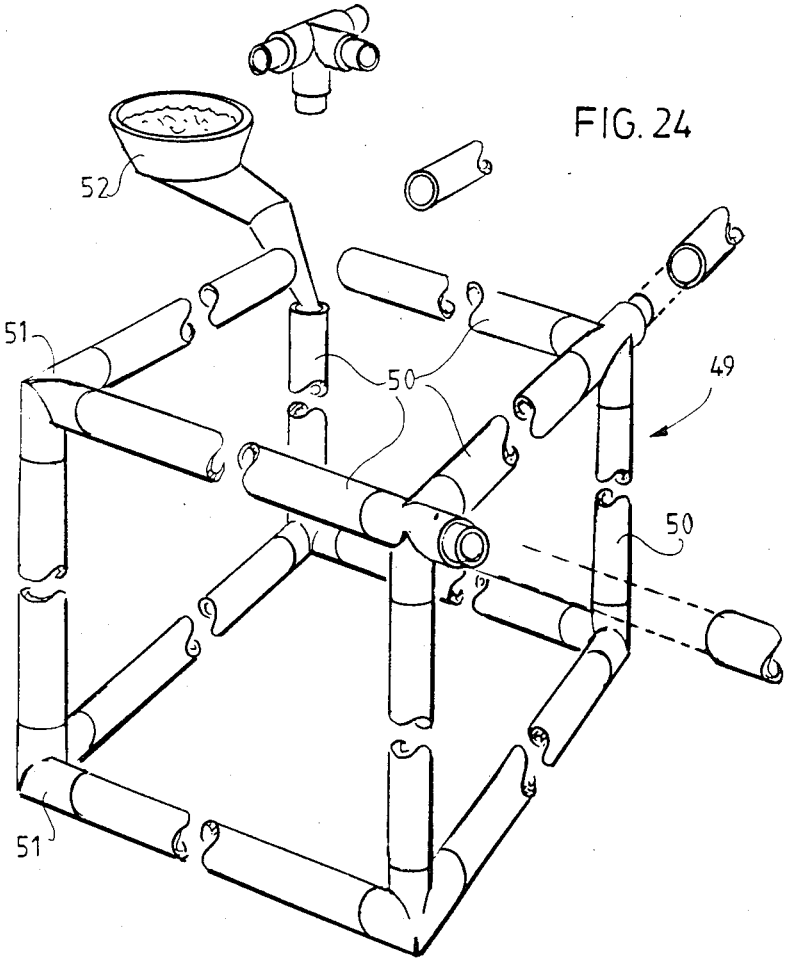
FIG. 24 is a supporting beam for a roof construction.

FIG. 24 shows a cube-shaped structure 49 which serves as roof support. This support 49 comprises tubular parts 50 which are connected to one another with corner elements 51 and, as is indicated symbolically by a funnel 52, are filled by pouring with for example concrete or sand.

Figure 25:
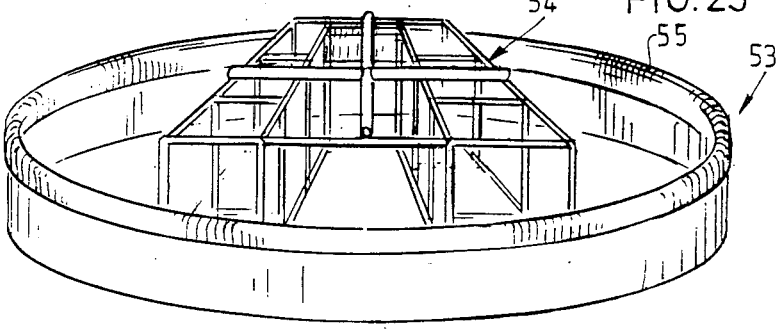
FIG. 25 is a reservoir with an extensive roof supporting construction.

FIG. 25 shows a reservoir 53 with a roof support 54 which is constructed in accordance with the embodiment as in FIG. 24.

FIG. 26 shows an upper edge of a reservoir which is provided with a cover 55 (see also FIG. 25), this cover displaying at least one opening 56, which connects with the environment via a water seal 57. A roof 58 consists of a foil that is supported in the centre by support 54 and connected at the edges to edge 59.

FIG. 27 shows, in contrast to the fixed connection 60 of roof 58 with wall part 30, that roof 58 can be provided along its circumference with loops 61 which can be hooked round knobs 62 in the way shown in FIG. 28.

Figure 29:
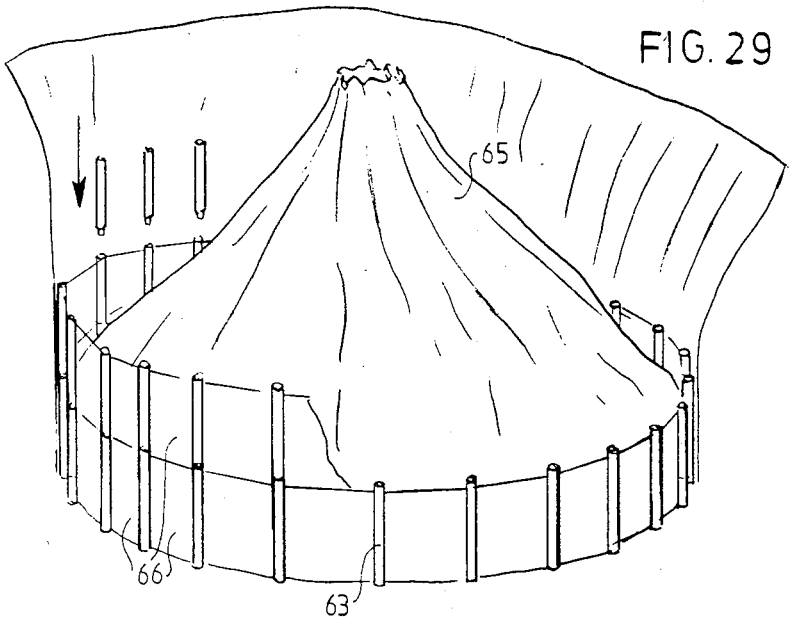
FIG. 29 is a reservoir with a raised wall in a perspective, partly broken away view.

FIG. 29 shows that use can also be made of connectable vertical piles 63, namely piles having a lower part 64 of smaller diameter, such that this lower part fits inside the upper part of another identical pile. In this way any required height of a reservoir according to the invention can in principle be realised.

FIG. 29 also shows the way in which the sack 65 serving as impermeable foil can in this case be placed so as to be later folded outwards such that it comes to rest against the members 66 having tensile strength, such as ropes or wire meshes, which are arranged between piles 63.

Figure 31:
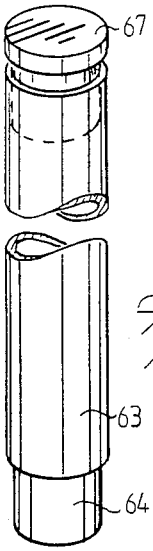
FIG. 31 shows a pile in the form of a hollow tube, with sealing.

FIG. 31 shows a pile 63 in detail. The uppermost pile can be closed by means of a stopper 67.

Figure 30:
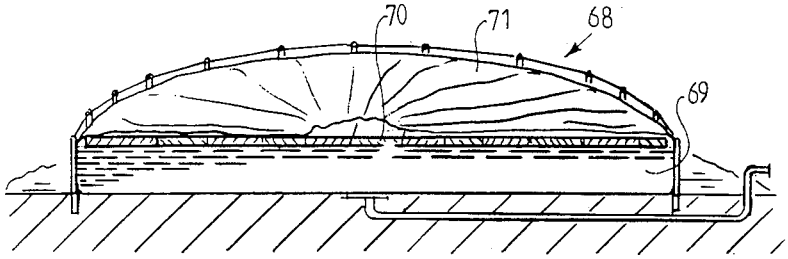
FIG. 30 is a reservoir with a "floating" roof.

FIG. 30 shows a reservoir 68 which is filled with a liquid 69 on which rests a covering 70. On covering 70 rests a foil form roof 71.

Figure 32:
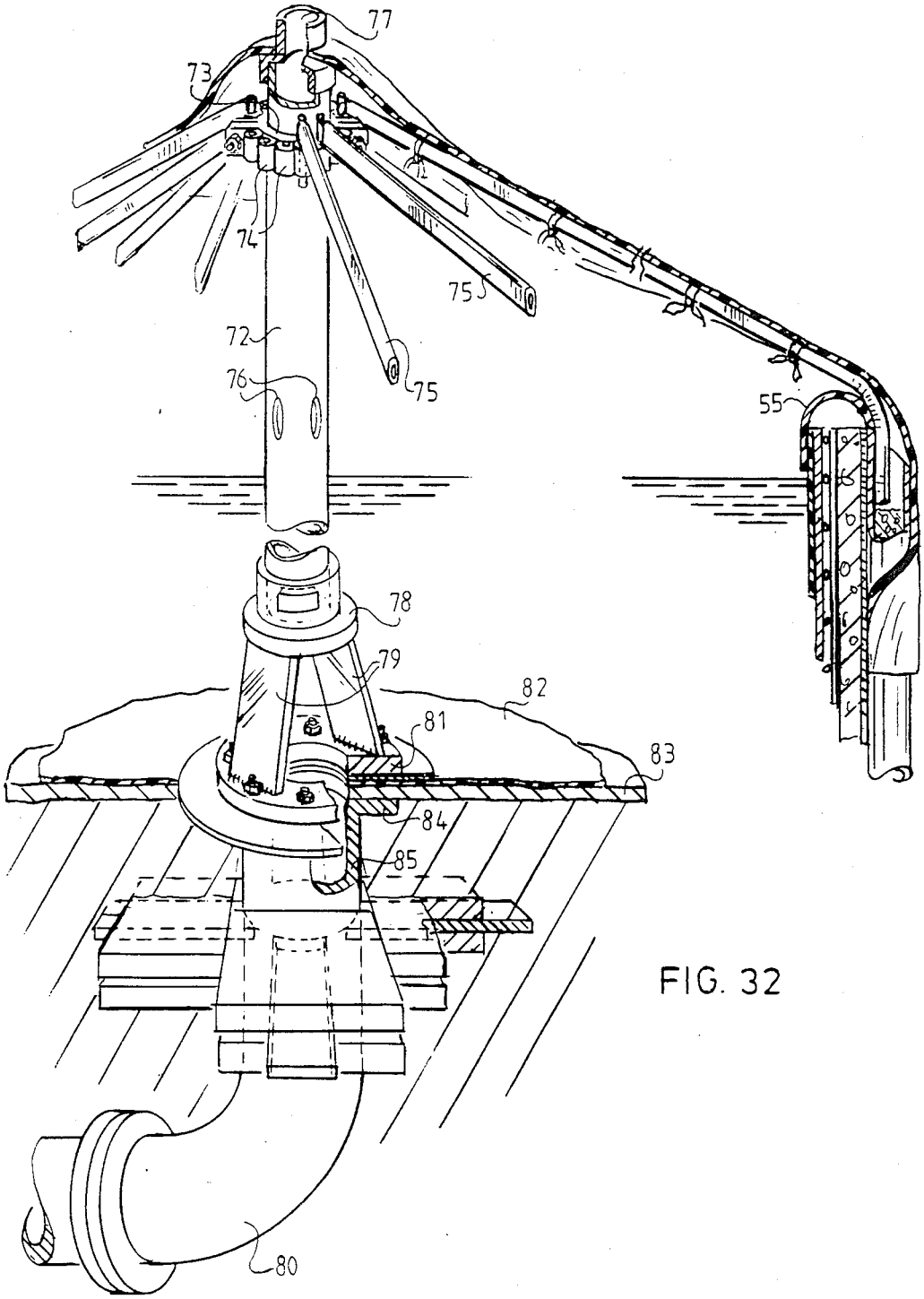
FIG. 32 is an alternative roof construction.

FIG. 32 shows another possible bearing construction for a roof. This bearing construction comprises a vertical hollow pipe 72 on the upper part of which is attached a collar 73 provided with supporting eyes 74 for radial bars 75 the ends of which can be bent over to rest on the annular cover 55. In another undrawn embodiment use is made of a cover with supporting eyes or hole which is placed on pipe 72.

Pipe 72 is provided with holes 76 and an upper end open for de-aeration. It is supported by a table 78 which is supported by supports 79. Under these emerges a feed/outlet pipe 80. Supports 79 bear on a flange construction 81 which co-operates with sealing via an impermeable foil 82 and a bottom part 83 with a flange part 84 which is joined to a pipe connection 85.

Figure 33:
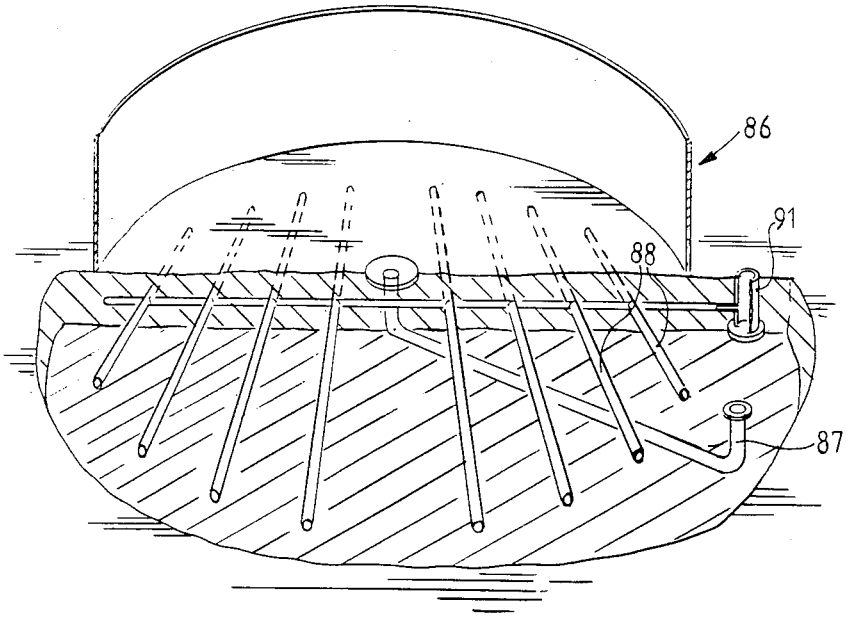
FIG. 33 is a reservoir with a draining system.

Finally FIG. 33 shows schematically a reservoir 86 that is provided with a feed system 87 and a draining system 88 having a sample pit 91.

The following general remarks are made within the framework of the invention. As a variation on a circular form, other suitable shapes for the reservoir can be used, whereby it is noted that the circular form ensures homogenous stress in the wall, which furthers the consistency of shape.

The fixing tubes that are to be placed in the ground, for example tubes 10, can consist of any suitable material, for example PVC. In the placing of these tubes 10 it is preferably ensured that they project some distance above the ground, so that they can be easily found again for the positioning of piles 12. The wire meshes can be placed in register, after which the piles or steel tubes 12 are placed and arranged in the positioning tubes 10. This operation can if desired be prepared per group. After its completion steel tubes 12 can if necessary be filled in the way indicated in FIG. 6 with a curing material such as concrete in order to prevent deformation under load.

For the force distributing boards 20, 22 use can be made of plastic boards which are brought on the market by the DSM concern under the trade name REKO boards.

Depending on the filling, liquid, solid substance, an extra interior covering may or may not be necessary.

In a simple embodiment outer wall parts 30 and the filling by pouring with for example concrete 31 can be omitted.

The REKO boards can be provided with an overlapping or free end zone with connecting piece with a view to expansion/shrinkage, particularly in the case of temperature changes.

Ropes 34 in the embodiment according to FIGS. 18, 20, 21, 22, 23 can be of the type on the market under the trade name "POLYSTAL".

Attention is drawn to the fact that the variant according to FIG. 20 is not provided with an extra, closed interior covering.

With reference to FIG. 2 it is also noted that connections 15 and 16 are placed such that the user can transport in this case manure to and from the reservoir using his own means without an extra pump.

I claim:

1. A reservoir construction comprising the combination of a plurality of consecutively placed separate elements comprising ground-supported bottom means for defining a barrier impermeable to fluent material contained within the reservoir, a series of vertical piles disposed in spaced relation to each other in surrounding peripheral relation to the bottom means and embedded in the ground, wire mesh means secured to the piles for defining a reservoir space and a reaction structure encircling the reservoir space which is resiliently resistant to hydrostatic pressure imposed thereon by fluent material resident in the reservoir space, and upstanding wall means cooperating with the bottom means and supported by the reaction structure for transferring the hydrostatic pressure to the reaction structure and for completing impermeability of the reservoir space to the fluent material.

2. A reservoir construction as defined in claim 1 wherein the bottom means is in the form of a plastic layer sandwiched between cementitious layers.

3. A reservoir construction as defined in claim 2 wherein the wall means is in the form of a wall structure structures arranged inside the piles and cumulatively encircling the reservoir space.

4. A reservoir construction as defined in claim 2 wherein the wall means is in the form of discrete wall structures arranged inside the piles to react thereaganist and cumulatively encircling the reservoir space.

5. A reservoir construction as defined in claim 2 wherein the wall means is in the form of a cementitious wall structure arranged outside the piles and bonded to the wire mesh means.

6. Reservoir as claimed in claim 3 characterised in that the bottom and the upright wall connecting thereto comprise a layer of plastic material.

7. Reservoir as claimed in claim 6, characterised in that between the vertical wire mesh attached to the vertical piles and the upright wall is arranged a substantially rigid board for distributing outwardly directed forces.

8. Reservoir as claimed in claim 5 characterised in that the bottom displays a layered construction consisting of a plastic layer arranged between two substantially rigid, for example (foaming) concrete, layers.

9. Reservoir as claimed in claim 1 characterised in that in addition to the upright wall part resting the inner side of the piles, an upright wall part is arranged extending around the outer side of said piles and the space between both said wall parts is filled by pouring with a curing material, for example (floating) concrete.

10. Reservoir as claimed in claim 1 characterised by a possibly slack roof covering which extends over the upper edge of the upright wall and is supported in the center by for example a constructed horizontal beam.

11. Reservoir as claimed in claim 10, characterised in that the supporting beam supports on the bottom of said reservoir.

12. Reservoir as claimed in claim 10, characterised by a constructed supporting beam consisting of tubes filled by pouring.

13. Reservoir as claimed in claim 1 characterised in that the upright wall is provided close to its upper edge and above the maximum filling level of said reservoir with at least one gas outlet duct connecting to a tube with water seal.

14. Reservoir as claimed in claim 1 characterised in that the upright wall takes the form of an at least partially prestressed construction.

15. Reservoir as claimed in claim 1 characterised in that the upright wall rests on a bottom part over which said wall is slidable for displacement under changing load conditions, for example varying thermal stresses, varying degree of filling and/or varying wind load.

16. A reservoir construction comprising the combination of ground-supported bottom means for defining a barrier impermeable to fluent material contained within the reservoir and including a flexible plastic sheet having a peripheral marginal edge, a series of vertical piles disposed in spaced relation to each other in penetrating relation to the marginal edge and embedded in the ground, wire mesh means secured to the piles inwardly of the marginal edge of the plastic sheet for defining a reservoir space and a reaction structure encircling the reservoir space which is resistant to hydrostatic pressure imposed thereon by fluent material resident in the reservoir space, and wall means including a cylindrical plastic sheet cooperating with the bottom means and supported by the reaction structure for transferring the hydrostatic pressure to the reaction structure and for completing impermeability of the reservoir space to the fluent material.

17. A reservoir construction as defined in claim 16 wherein the wire mesh means includes variably spaced horizontal circumscribing elements to compensate for hydrostatic pressure and wherein the wall means also includes a rigid wall structure interposed between the cylindrical plastic sheet and the wire mesh means.

18. A reservoir construction as defined in claim 17 wherein the upper edge of the cylindrical plastic sheet is overlapped over the upper edge of the rigid wall structure.

* * * * *